US009719387B2

(12) United States Patent
Tsumagari et al.

(10) Patent No.: US 9,719,387 B2
(45) Date of Patent: Aug. 1, 2017

(54) COMBUSTION APPLIANCE FOR RAISING THE TEMPERATURE OF EXHAUST GAS

(75) Inventors: Ichiro Tsumagari, Tokyo (JP); Ryo Shibuya, Tokyo (JP); Masazumi Takayasu, Tokyo (JP)

(73) Assignee: HINO MOTORS, LTD., Tokyo (JP)

( * ) Notice: Subject to any disclaimer, the term of this patent is extended or adjusted under 35 U.S.C. 154(b) by 1375 days.

(21) Appl. No.: 13/581,323

(22) PCT Filed: Mar. 3, 2011

(86) PCT No.: PCT/JP2011/001252
§ 371 (c)(1),
(2), (4) Date: Aug. 27, 2012

(87) PCT Pub. No.: WO2011/108273
PCT Pub. Date: Sep. 9, 2011

(65) Prior Publication Data

US 2012/0322012 A1 Dec. 20, 2012

(30) Foreign Application Priority Data

Mar. 5, 2010 (JP) ..... 2010-049399

(51) Int. Cl.
*F23D 11/00* (2006.01)
*F01N 3/025* (2006.01)
*F23G 7/06* (2006.01)

(52) U.S. Cl.
CPC ..... *F01N 3/0256* (2013.01); *F01N 3/025* (2013.01); *F23G 7/065* (2013.01);
(Continued)

(58) Field of Classification Search
CPC ..... F01N 3/025; F01N 3/0256
USPC ..... 431/198, 200
See application file for complete search history.

(56) References Cited

U.S. PATENT DOCUMENTS 2,570,771 A * 10/1951 Conron ..... F23D 5/00 126/45
3,953,002 A * 4/1976 England, Jr. ..... B01F 3/10 261/76

(Continued)

FOREIGN PATENT DOCUMENTS

DE EP 0470361 A1 * 2/1992 ..... F01N 3/025
JP 51 45334 4/1976

(Continued)

OTHER PUBLICATIONS

International Search Report Issued Mar. 29, 2011 in PCT/JP11/01252 Filed Mar. 3, 2011.

(Continued)

*Primary Examiner* — Avinash Savani
*Assistant Examiner* — Aaron Heyamoto
(74) *Attorney, Agent, or Firm* — Oblon, McClelland, Maier & Neustadt, L.L.P.

(57) ABSTRACT

Injection nozzle 7 and electrode rods 8 and 9 (ignitor) are surrounded by double-cylinder flame stabilizer 10. Toroidal blocking plate 13 closes between inner and outer cylinders 11 and 12 of the stabilizer at its distal end whose proximal end is connected with line 15 for introducing combustion air 14 to between the cylinders. Inflow holes 16 are formed throughout the inner cylinder at its proximal end. Peripheral fins 17 are formed peripherally on the inner cylinder radially inwardly through cutting and bending-up at positions shifted from the inflow holes toward the distal end of the inner cylinder such that combustion air is introduced from circumferentially to form swirling flow inside the inner cylinder. End fins 18 are formed on the blocking plate in fuel injection direction through cutting and bending-up such that combustion air is discharged circumferentially to form swirling flow around flame 21.

13 Claims, 6 Drawing Sheets

(52) U.S. Cl.
CPC ..... *F01N 2240/14* (2013.01); *F01N 2240/20* (2013.01); *F01N 2470/18* (2013.01); *F23D 2900/21003* (2013.01); *F23D 2900/21006* (2013.01)

(56) References Cited

U.S. PATENT DOCUMENTS

| | | | | |
|---|---|---|---|---|
| 2005/0150217 | A1 | 7/2005 | Crawley et al. | |
| 2005/0153252 | A1 * | 7/2005 | Crawley ..... | F01N 3/025 431/5 |
| 2008/0307780 | A1 | 12/2008 | Iverson et al. | |

FOREIGN PATENT DOCUMENTS

| | | | | |
|---|---|---|---|---|
| JP | 59056010 | A | * | 3/1984 |
| JP | 59 91414 | | | 6/1984 |
| JP | 62-35852 | Y2 | | 9/1987 |
| JP | 5 86845 | | | 4/1993 |
| JP | 6 167212 | | | 6/1994 |
| JP | 2008-25588 | A | | 2/2008 |
| JP | 4131064 | B2 | | 6/2008 |
| WO | WO 2008/157015 | A1 | | 12/2008 |

OTHER PUBLICATIONS

Extended European Search Report issued Sep. 12, 2014 in Patent Application No. 11750386.2.
International Search Report dated Mar. 29, 2011 in PCT/JP11/01252 Filed Mar. 3, 2011.

* cited by examiner

COMBUSTION APPLIANCE FOR RAISING THE TEMPERATURE OF EXHAUST GAS

TECHNICAL FIELD

The present invention relates to a combustion appliance for raising the temperature of exhaust gas.

BACKGROUND ART

Conventionally, a diesel engine has a particular filter incorporated in an exhaust pipe for flow of exhaust gas to capture particulate matters or particulates in the exhaust gas. An oxidation catalyst having active species such as Pt or Pd is integrally carried by this kind of particulate filter for self-burning of the captured particulates even at a minimally low exhaust temperature.

However, a captured amount of particulates will exceed a treated amount of particulates in operation areas with low exhaust temperature levels. Continued operation with such low exhaust temperature levels may hinder sufficient regeneration of the particulate filter, resulting in excessive accumulation of the captured particulates in the particulate filter.

Conventionally proposed in this connection is to arrange a combustion appliance for raising the temperature of exhaust gas upstream of the particulate filter so as to introduce the exhaust gas produced by burner combustion and raised in temperature by the combustion appliance to the particulate filter and positively raise a catalyst bed temperature of the particulate filter and burn off the captured particulates, thereby regenerating the particulate filter.

There already exist, for example, the following Patent Literatures 1 and 2 as prior art documents on techniques for temperature raising of a particulate filter or the like by use of a burner.

CITATION LIST

Patent Literature

[Patent Literature 1] JP 5-086845A
[Patent Literature 2] JP 6-167212A

SUMMARY OF INVENTION

Technical Problems

However, disadvantageously, the combustion appliance for raising the temperature of exhaust gas arranged in the exhaust system of the automobile is liable to be exposed to a risk of flame-out and imperfect combustion since repeated acceleration and deceleration of the automobile drastically change an operation condition and drastically vary a flow rate of the exhaust gas.

The invention was made in view of the above and has its object to provide a combustion appliance for raising the temperature of exhaust gas which has high flame-stabilizing performance and can effectively prevent flame-out and imperfect combustion.

Solution to Problems

The invention is directed to a combustion appliance for raising the temperature of exhaust gas arranged in a bend of an exhaust pipe to raise the temperature of exhaust gas through burner combustion, characterized in that it comprises a fuel injection nozzle for injecting fuel downstream in a direction of flow of the exhaust gas in the bend of said exhaust pipe, an ignitor for igniting fuel mist injected from said fuel injection nozzle, a double-cylinder type flame stabilizer coaxially surrounding the injection nozzle and the ignitor about the injection nozzle, a toroidal blocking plate on a distal end of said stabilizer for closing between inner and outer cylinders of said stabilizer, a combustion air introduction line connected to a proximal end of said stabilizer for introducing combustion air to between said inner and outer cylinders, a plurality of combustion air inflow holes formed throughout a periphery of said inner cylinder at a proximal end thereof, a plurality of peripheral fins formed on the periphery of said inner cylinder radially inwardly through cutting and bending-up at positions shifted from said inflow holes toward the distal end of the inner cylinder such that the combustion air is introduced from circumferentially to form a swirling flow inside the inner cylinder and a plurality of end fins formed on said blocking plate in a direction of fuel injection through cutting and bending-up such that the combustion air is discharged circumferentially to form a swirling flow around flame blown out of said inner cylinder.

Thus, in the combustion appliance for raising the temperature of exhaust gas configured as described above, the fuel mist injected from the fuel injection nozzle in the stabilizer which is not exposed to the flow of the exhaust gas is ignited by the ignitor, and flame is blown out of the inner cylinder and is mixed with the exhaust gas to raise the temperature of the exhaust gas. In this case, the combustion air introduced between the inner and outer cylinders by the combustion air introduction line is introduced through the combustion air inflow holes into the inner cylinder at the proximal end thereof to reliably avoid shortage of oxygen in the ignition, and the combustion air is introduced through the peripheral fins into the inner cylinder to form the swirling flow for facilitated early mixing of the fuel mist with the combustion air, thereby stabilizing the ignition to the fuel mist.

The fuel mist injected from the fuel injection nozzle is entrained on the swirling flow formed by the peripheral fins to spread in a spirally swirling manner and thus have an prolonged dwell time required for a combustion reaction while being satisfactorily mixed with the surrounding combustion air, thereby enhancing the combustibility of the fuel mist to substantially improve the flame-stabilizing performance. That the swirling flow formed by the end fins surrounds the flame blown out of the inner cylinder and mixed with the exhaust gas contributes to effective compensation for the combustion air and satisfactory mixing with the exhaust gas. Thus, the flame-stabilizing performance is substantially enhanced also by the swirling flow formed by the end fins.

It is also preferable in the invention that it further comprises a mixer arranged on the distal end of the stabilizer and divergent in a direction of fuel injection and a plurality of tapered-surface fins formed on a tapered surface of said mixer radially inwardly of the mixer through cutting and bending-up such that the exhaust gas is introduced from circumferentially to form a swirling flow inside the mixer.

In this manner, the flame blown out of the inner cylinder stably spreads without being fanned by the sidewise inflow of the exhaust gas, and the sidewise inflow of the exhaust gas is introduced through the tapered-surface fins of the mixer to form a swirling flow around flame in the mixer, thereby achieving satisfactory mixing with the flame in the mixer.

It is preferable in the invention that the peripheral and end fins are made through cutting and bending-up circumferentially in opposite directions such that the swirling flow can be formed by the end fins in a direction opposite to that of the swirling flow formed by the peripheral fins. Further, it is preferable that the end and tapered-surface fins are made through cutting and bending-up circumferentially in the same direction such that the swirling flow can be formed by the tapered-surface fins in a forward direction same as that of the swirling flow formed by the end fins.

It is preferable in the invention that an opening area of the end fins is set to 50-70% of a total opening area of the combustion air inflow holes and peripheral and end fins and the remainder is allocated as opening areas of the combustion air inflow holes and of the peripheral fins. In particular, it is preferable that 10% of the total opening area is allocated as the opening area of the combustion air inflow holes.

It is assumed that, to a total opening area of the combustion air inflow holes and peripheral and end fins, an opening area of the combustion air inflow holes is set to 10%, an opening area of the end fins is set to 50-70% and the remainder is allocated as the opening area of the peripheral fins. In this case, it is preferable that a bend-up angle of the peripheral fins is set to 40-55° to the periphery of the inner cylinder.

Advantageous Effects of Invention

In the combustion appliance for raising the temperature of the exhaust gas according to the invention, various beneficial effects can be obtained as follows:

(I) The combustion air introduced through the combustion air inflow holes into the periphery of the inner cylinder at the proximal end thereof reliably avoids shortage of oxygen in the ignition, and the swirling flow of the combustion air formed by the peripheral fins facilitates early mixing of the combustion air with the fuel mist, thereby stabilizing the ignition of the fuel mist. In addition, the swirling flows formed by the peripheral and end fins enhances the combustibility to substantially improve the flame-stabilizing performance. Thus, the exhaust gas can be raised in temperature while effectively preventing flame-out and imperfect combustion.

(II) When a mixer divergent in a direction of fuel injection is arranged on the distal end of the stabilizer and a plurality of tapered-surface fins are formed on a tapered surface of the mixer radially inwardly of the mixer through cutting and bending-up such that exhaust gas is introduced from circumferentially to form a swirling flow inside the mixer, the flame blown out of the inner cylinder can stably spread without being fanned by the flow of the exhaust gas, and the flow of the exhaust gas is introduced through the tapered-surface fins of the mixer to satisfactorily mix the exhaust gas with flame in the mixer. Thus, lowering of the combustibility due to the mixing with the exhaust gas can be remarkably suppressed to prevent flame-out and imperfect combustion more effectively.

(III) The peripheral and end fins may be made circumferentially in opposite directions through cutting and bending-up such that the swirling flows can be formed by the peripheral and end fins circumferentially in opposite directions. The end and tapered-surface fins may be made circumferentially in the same direction through cutting and bending-up such that swirling flows can be formed by the end and tapered-surface fins circumferentially in the same forward direction. The opening area of the end fins may be set to 50-70% of the total opening area of the combustion air inflow holes and peripheral and end fins, and the remainder is allocated to the opening areas of the combustion air inflow holes and of the peripheral fins. In particular, 10% of the total opening area may be allocated as the opening area of the combustion air inflow holes. Furthermore, in such allocation, a bend-up angle of the peripheral fins may be set to 40-55° to the periphery of the inner cylinder. Thus, combustibility can be more effectively improved to prevent flame-out and imperfect combustion.

DESCRIPTION OF EMBODIMENT

An embodiment of the invention will be described with reference to the drawings.

Figure 1:
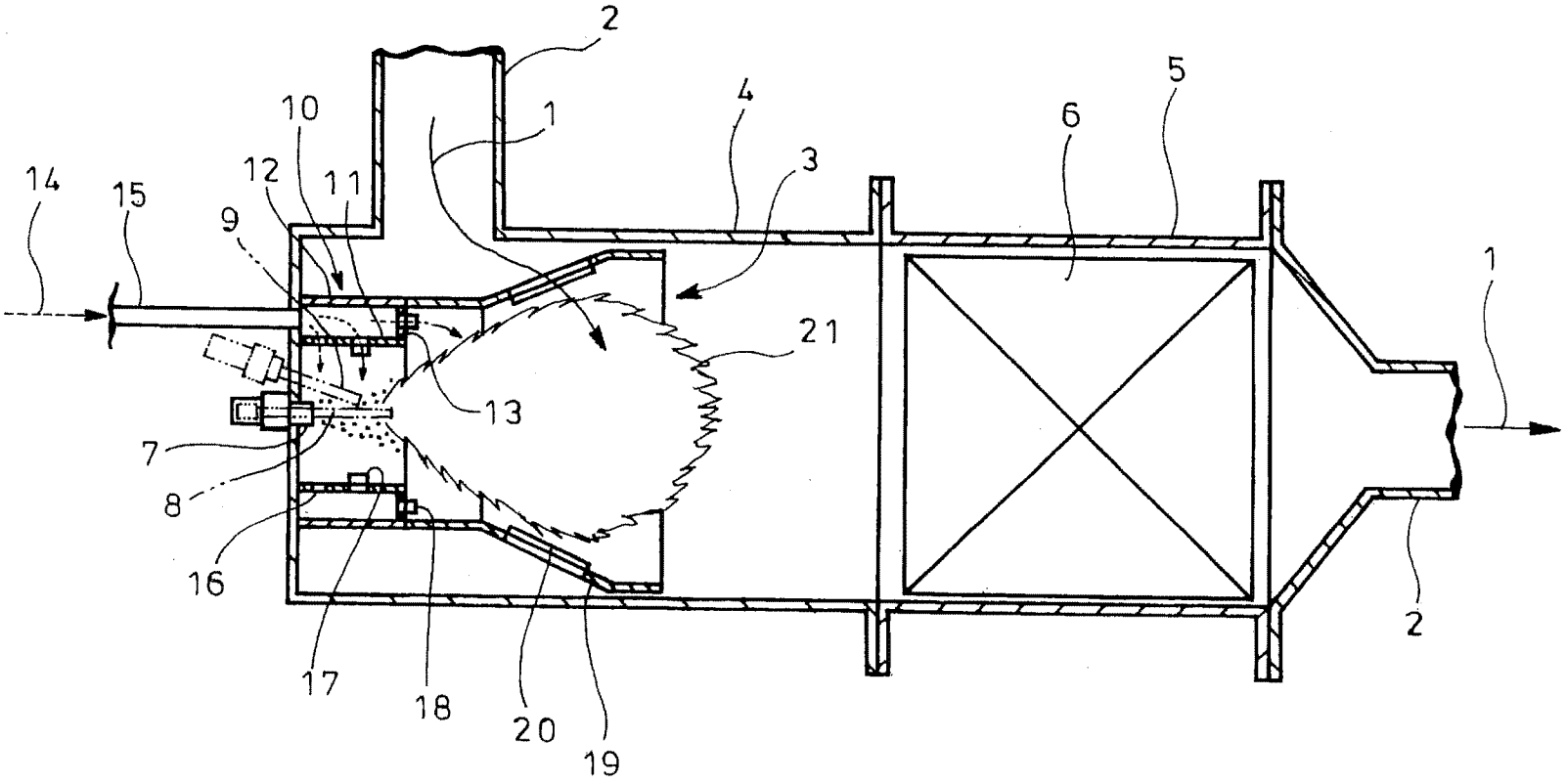
FIG. 1 is a sectional view showing an embodiment of the invention.

FIG. 1 shows the embodiment of the invention. In FIG. 1, reference numeral 2 denotes an exhaust pipe which guides exhaust gas 1 having passed through a turbine (not shown) of a turbocharger. The exhaust pipe 2 has an L-shaped bend in which arranged is a combustion appliance 3 for raising the temperature of the exhaust gas 1 by burner combustion.

The bend of the exhaust pipe 2 is provided by a casing 4 arranged substantially perpendicular to the exhaust pipe 2 extending from upstream. Encased in the casing 4 is the combustion appliance 3, and interposed between the casing 4 and the exhaust pipe 2 on a downstream side is a particulate filter 6 encased in a further casing 5.

On a side of the casing 4 opposite to the particulate filter 6, the combustion appliance 3 includes a fuel injection nozzle 7 which injects the fuel downstream in a direction of flow of the exhaust gas 1 and a pair of electrode rods 8 and 9 (an ignitor illustrated by imaginary lines in FIG. 1 since it is arranged in a sectional phase different from that of the casing 4) which generate spark discharge therebetween against fuel mist injected through a distal end of the injection nozzle 7. The fuel injection nozzle 7 and electrode rods 8 and 9 are coaxially surrounded by a double-cylinder type flame stabilizer 10 around the nozzle 7.

Figure 2:
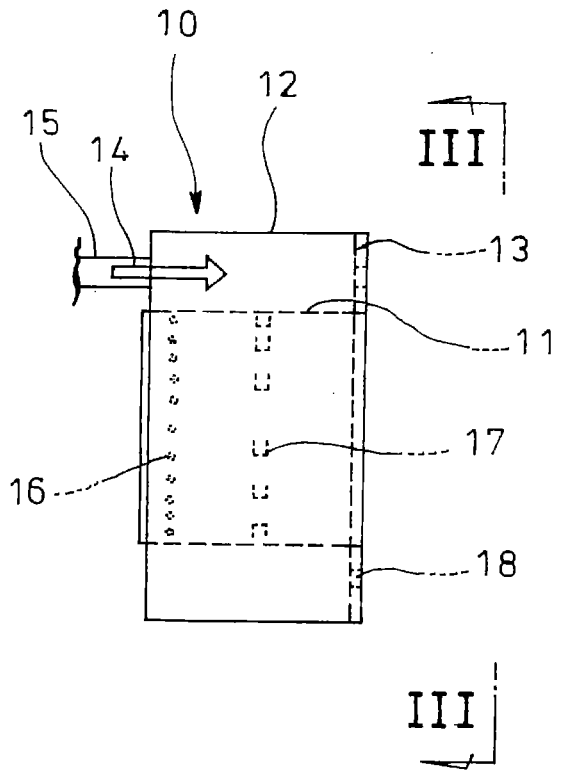
FIG. 2 is a side view showing particulars of a flame stabilizer in FIG. 1.
Figure 3:
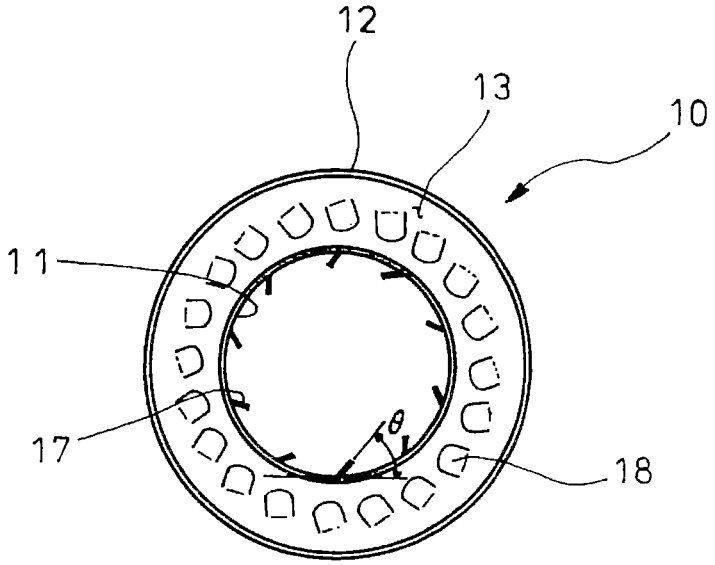
FIG. 3 is a view looking in a direction of arrows III in FIG. 2.

Particulars of the stabilizer 10 are as shown in FIGS. 2 and 3. Between inner and outer cylinders 11 and 12 of the stabilizer 10, the stabilizer 10 is closed at its distal end with a toroidal blocking plate 13 and is connected at its proximal end with a combustion air introduction line 15 which introduces part of intake extracted through a discharge end of a compressor (not shown) of the turbocharger into between the inner and outer cylinders 11 and 12 as combustion air 14.

A plurality of combustion air inflow holes 16 are formed throughout a periphery of the inner cylinder 11 at the proximal end thereof. A plurality of peripheral fins 17 are formed on the periphery of the inner cylinder 11 radially inwardly at positions shifted from the inflow holes 16 toward the distal end of the inner cylinder through cutting and bending-up such that the combustion air 14 can be introduced from circumferentially to form a swirling flow inside the inner cylinder 11.

Figure 4:
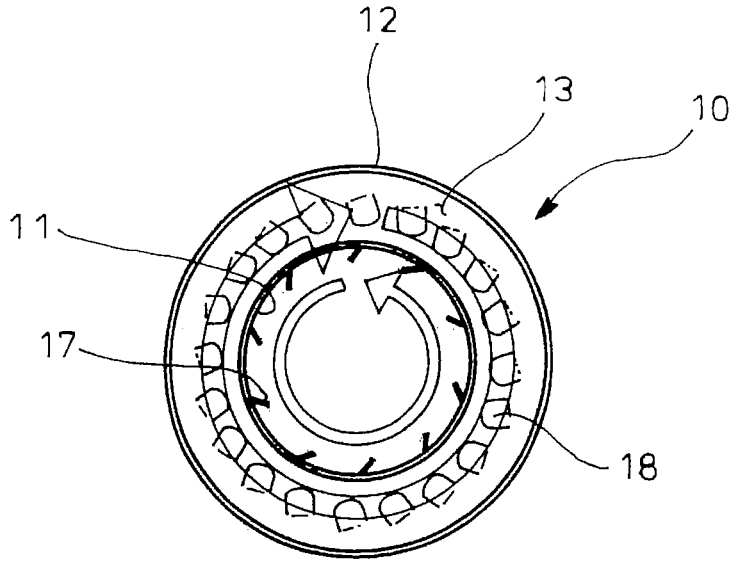
FIG. 4 is an explanatory view on swirling flows by peripheral and end fins in FIG. 3.

A plurality of end fins 18 are also formed on the blocking plate 13 in a direction of fuel injection through cutting and bending-up such that the combustion air 14 can be discharged circumferentially to form a swirling flow around flame 21 blown out of the inner cylinder 11. As shown in FIG. 4, the peripheral and end fins 17 and 18 are made circumferentially in opposite directions through cutting and bending-up such that the swirling flows can be formed by the fins 17 and 18 circumferentially in opposite directions.

Figure 5:
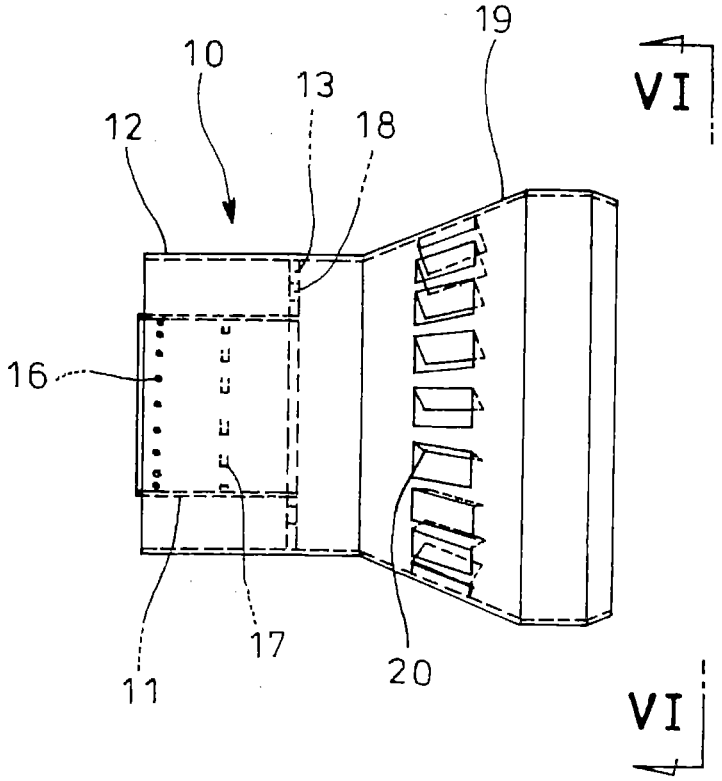
FIG. 5 is a side view showing particulars of a mixer in FIG. 1.
Figure 6:
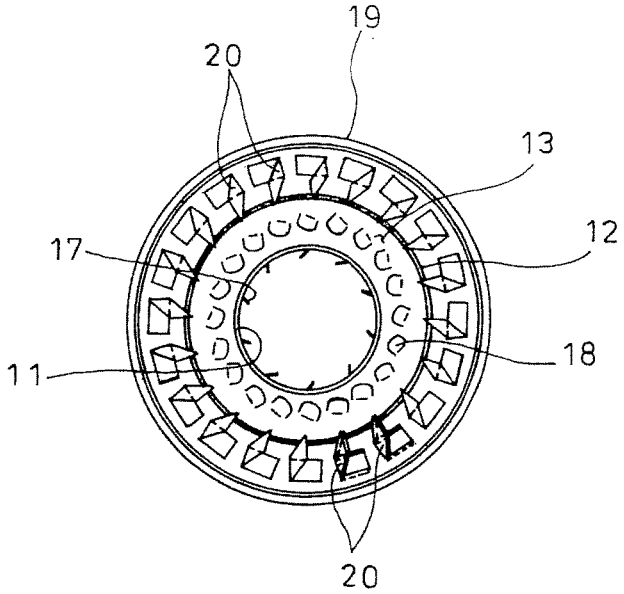
FIG. 6 is a view looking in a direction of arrows VI in FIG. 5.

In the embodiment, as specifically detailed in FIGS. 5 and 6, arranged on the distal end of the stabilizer 10 is a mixer 19 which is divergent in a direction of fuel injection. A plurality of tapered-surface fins 20 are formed on a tapered surface of the mixer 19 radially inwardly through cutting and bending-up such that the exhaust gas 1 can be introduced from circumferentially to form a swirling flow inside the mixer 19. The end and tapered-surface fins 18 and 20 are made circumferentially in the same direction through cutting and bending-up such that the swirling flows can be formed by the fins 18 and 20 circumferentially in the same forward direction.

Thus, in the combustion appliance 3 configured as described above, the fuel mist injected from the injection nozzle 7 within the stabilizer 10 which is not exposed to the flow of the exhaust gas 1 is ignited by the spark discharge of the electrode rods 8 and 9; the flame 21 is blown out of the inner cylinder 11 and is mixed with the exhaust gas 1 to raise the temperature of the exhaust gas 1. At this time, the combustion air 14 introduced from the combustion air introduction line 15 into between the inner and outer cylinders 11 and 12 of the stabilizer 10 is introduced through the inflow holes 16 into the inner cylinder 11 at the proximal end thereof to reliably avoid shortage of oxygen in the ignition, and the combustion air 14 is introduced through the peripheral fins 17 into the inner cylinder 11 to form the swirling flow for facilitated early mixing of the fuel mist with the combustion air 14, thereby stabilizing the ignition of the fuel mist.

Since the fuel mist injected from the fuel injection nozzle 7 is entrained on the swirling flow formed by the peripheral fins 17 and spreads in a spirally swirling manner, a dwell time required for a combustion reaction is prolonged while attaining satisfactory mixing with the surrounding combustion air 14; thus, the combustibility of the fuel mist is enhanced to substantially improve flame stability. That the swirling flow formed by the end fins 18 surround the flame 21 blown out of the inner cylinder 11 and mixed with the exhaust gas 1 contributes to effective compensation for the combustion air 14 and satisfactory mixing with the exhaust gas 1. Thus, the flame-stabilizing performance is substantially improved also by the swirling flow formed by the end fins 18.

In addition, the mixer 19 divergent in the direction of fuel injection is arranged on the distal end of the stabilizer 10, so that the flame 21 blown out of the inner cylinder 11 of the stabilizer 10 stably spreads without being fanned by the sidewise inflow of the exhaust gas 1. The sidewise inflow of the exhaust gas 1 is introduced through the tapered-surface fins 20 of the mixer 19 to form the swirling flow around the flame 21 in the mixer 19, thereby attaining satisfactory mixing with the flame 21 in the mixer 19.

Thus, according to the above embodiment, the combustion air 14 introduced through the inflow holes 16 into the inner cylinder 11 at the proximal end thereof reliably avoids shortage of oxygen in the ignition. The swirling flow of the combustion air 14 formed by the peripheral fins 17 can facilitate early mixing of the combustion air 14 with the fuel mist to stabilize the ignition of the fuel mist. In addition, the swirling flows formed by the peripheral and end fins 17 and 18 can enhance the combustibility to substantially improve the flame-stabilizing performance, so that the temperature of the exhaust gas 1 can be raised while effectively preventing flame-out and imperfect combustion.

The flame 21 blown out of the inner cylinder 11 of the stabilizer 10 can stably spread without being fanned by the flow of the exhaust gas 1, and the flow of the exhaust gas 1 can be introduced through the tapered-surface fins 20 of the mixer 19 to achieve satisfactory mixing with the flame 21 in the mixer 19. Thus, lowering of the combustibility due to the mixing with the exhaust gas 1 can be remarkably suppressed to effectively prevent flame-out and imperfect combustion.

Moreover, in the embodiment, the swirling flow formed by the end fins 18 is in a direction opposite of the direction of the swirling flow formed by the peripheral fins 17, so that in comparison with a case where both the swirling flows are in the forward direction, the combustibility can be more effectively enhanced to prevent flame-out and imperfect combustion.

Figure 7:
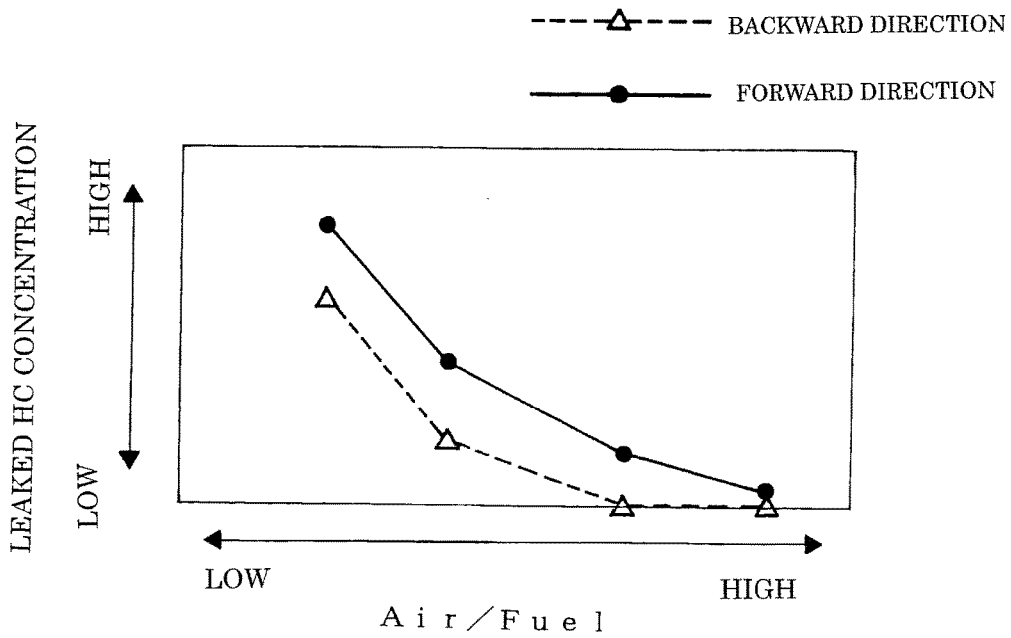
FIG. 7 is a graph showing variation in leaked HC concentration caused by directional difference of swirling flows by end and peripheral fins.
Figure 8:
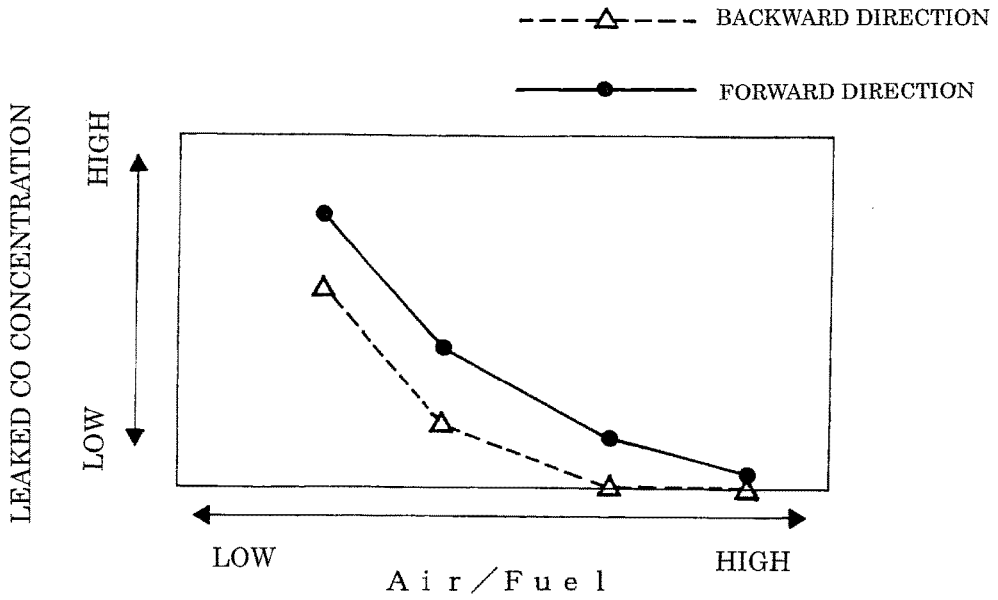
FIG. 8 is a graph showing variation in leaked CO concentration caused by directional difference of swirling flows by end and peripheral fins.

In fact, as plotted in FIGS. 7 and 8, verification experiments by the inventors revealed that leaked HC and CO concentrations are decreased and thus a combustion condition is improved when the swirling flow formed by the end fins 18 is in a direction opposite to a direction of the swirling flow formed by the peripheral fins 17 in comparison with a case where both the swirling flows are formed in the forward direction (HC as unburned fuel and CO produced by imperfect combustion are increased when combustibility is lowered). This tendency did not change regardless of any change in A/F (air-fuel ratio).

Further, in the embodiment, the swirling flow is formed by the tapered-surface fins 20 in the forward direction same as that of the swirling flow formed by the end fins 18, so that combustibility can be more effectively enhanced to prevent flame-out and imperfect combustion in comparison with a case where both the swirling flows are in opposite directions.

Figure 9:
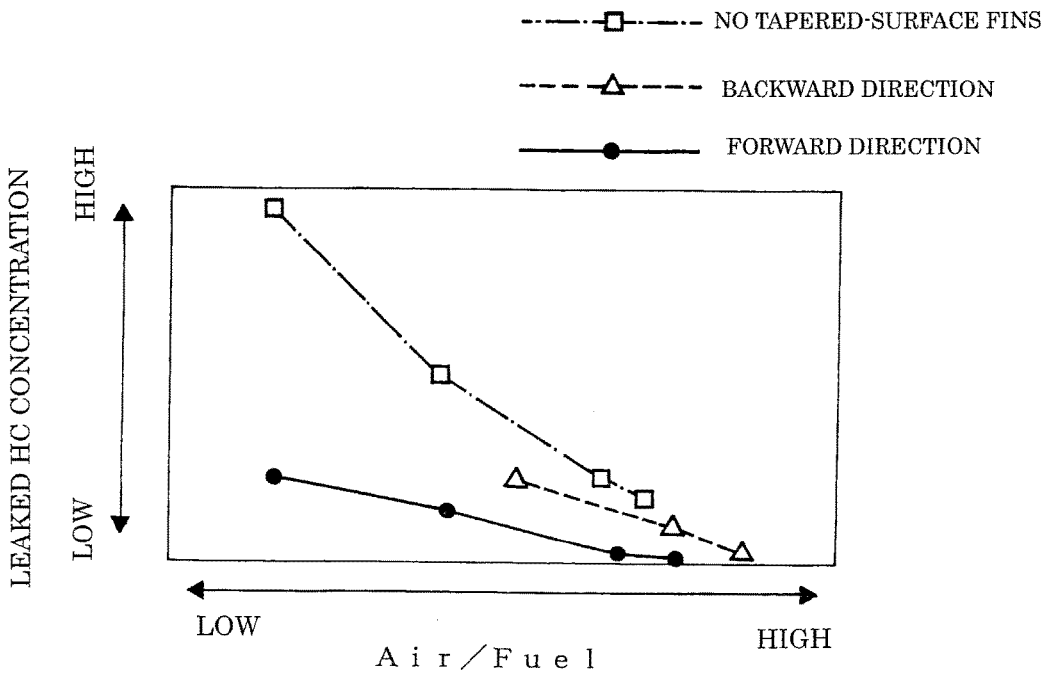
FIG. 9 is a graph showing variation in leaked HC concentration caused by directional difference of swirling flows by tapered-surface and end fins.

In fact, as plotted in FIG. 9, verification experiments by the inventors revealed that leaked CO concentration is decreased and thus the combustion condition is improved when the swirling flow formed by the tapered-surface fins 20 is in the forward direction same as that of the swirling flow formed by the end fins 18 in comparison with a case where both the swirling flows are formed in opposite directions. This tendency did not change regardless of any change in A/F (air-fuel ratio).

It is preferable that, to a total opening area of the inflow holes 16 and peripheral and end fins 17 and 18, an opening area of the end fins 18 is set to 50 to 70%, the remaining opening area being allocated as opening areas of the inflow holes 16 and of the peripheral fins 17. Thus, combustibility can be more effectively enhanced to prevent flame-out and imperfect combustion.

Figure 10:
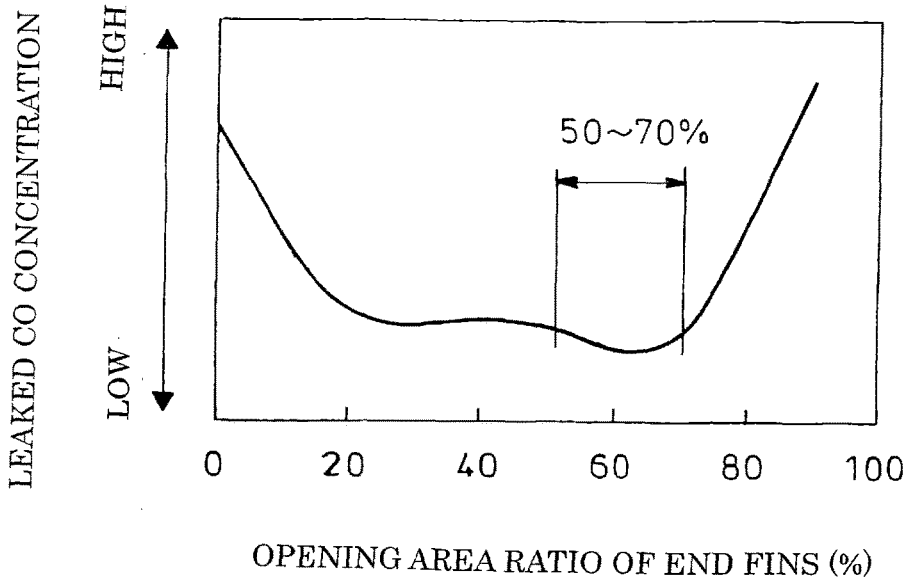
FIG. 10 is a graph showing a relationship between an opening area ratio of the end fins and the leaked CO concentration.

In fact, as plotted in FIG. 10, verification experiments by the inventors revealed that the leaked CO concentration is minimum to drastically improve the combustion condition when the opening area of the end fins 18 is set to 50-70%.

In particular, it is preferable that the opening area of the combustion air inflow holes 16 is allocated to 10% of the total opening area. When the opening areas of the inflow holes 16 and of the end fins 18 are set to 10% and 50-70% of the total opening area, respectively, and the remainder (20-40%) is allocated as the opening area of the peripheral fins 17, it is preferable that the bend-up angle of the peripheral fins 17 to the periphery of the inner cylinder 11 is set to 40-55°. Thus, combustibility can be more effectively improved to prevent flame-out and imperfect combustion.

Figure 11:
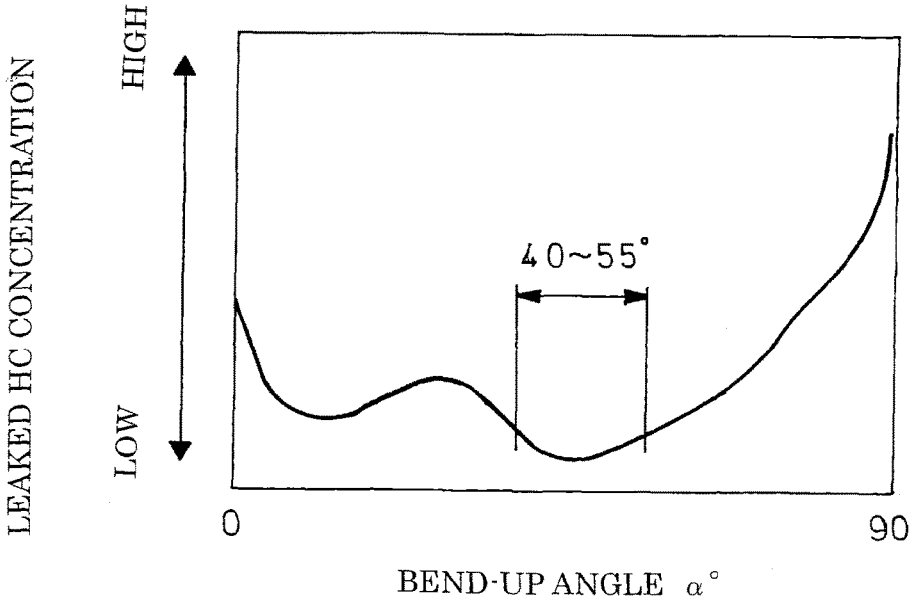
FIG. 11 is a graph showing a relationship between a bend-up angle of the peripheral fins and the leaked HC concentration.

In fact, as plotted in FIG. 11, verification experiments by the inventors revealed that the leaked HC concentration is minimum to substantially improve the combustion condition when the bend-up angle of the peripheral fins 17 to the periphery of the inner cylinder 11 is set to 40-55°.

The bend-up angle of the peripheral fins 17 is complemented here. The bend-up angle is an angle of the peripheral fin 17 measured at the proximal end thereof to a tangent to the periphery. The angle is indicated by θ in FIG. 3.

It is to be understood that the combustion appliance for raising the temperature of exhaust gas according to the invention is not limited to the above embodiment and that various changes and modifications may be made without departing from the scope of the invention. For example, a combustion appliance for raising the temperature of exhaust gas so as to regenerate a particulate filter is exemplified in the above; however, the combustion appliance may be used not only for regeneration of the particulate filter but also for raising temperatures of various catalysts up to active temperatures.

REFERENCE SIGNS LIST

1 exhaust gas
2 exhaust pipe
3 combustion appliance for raising the temperature of exhaust gas
4 casing (bend)
7 fuel injection nozzle
8 electrode rod (ignitor)
9 electrode rod (ignitor)
10 flame stabilizer
11 inner cylinder
12 outer cylinder
13 blocking plate
14 combustion air
15 combustion air introduction line
16 combustion air inflow hole
17 peripheral fin
18 end fin
19 mixer
20 tapered-surface fin
21 flame
θ bend-up angle

The invention claimed is:

1. A combustion appliance for raising a temperature of exhaust gas arranged in a bend of an exhaust pipe to raise the temperature of exhaust gas through burner combustion, the appliance comprising:

a fuel injection nozzle to inject fuel downstream in a direction of flow of the exhaust gas in the bend of said exhaust pipe, an ignitor to ignite fuel mist injected from said fuel injection nozzle, a double-cylinder type flame stabilizer coaxially surrounding the injection nozzle and the ignitor about the injection nozzle, a toroidal blocking plate on a distal end of said stabilizer to close between inner and outer cylinders of said stabilizer, a combustion air introduction line connected to a proximal end of said stabilizer to introduce combustion air to between said inner and outer cylinders, a plurality of combustion air inflow holes formed throughout a periphery of said inner cylinder at a proximal end thereof, a plurality of peripheral fins formed on the periphery of said inner cylinder radially inwardly through cutting and bending-up at positions shifted from said inflow holes toward a distal end of the inner cylinder such that the combustion air is introduced circumferentially to form a swirling flow inside the inner cylinder, and a plurality of end fins formed on said blocking plate in a direction of fuel injection through cutting and bending-up such that the combustion air is discharged circumferentially to form a swirling flow around flame blown out of said inner cylinder, wherein the peripheral fins and the end fins are made through cutting and bending-up circumferentially in opposite directions such that the swirling flow can be formed by the end fins in a direction opposite to that of the swirling flow formed by the peripheral fins, and wherein an opening area of the end fins is set to 50-70% of a total opening area of the combustion air inflow holes, the peripheral fins and the end fins, and a remainder is allocated as opening areas of the combustion air inflow holes and of the peripheral fins.

2. The combustion appliance for raising the temperature of the exhaust gas as claimed in claim 1, further comprising a mixer arranged on the distal end of the stabilizer and divergent in a direction of fuel injection and a plurality of tapered-surface fins formed on a tapered surface of said mixer radially inwardly of the mixer through cutting and bending-up such that the exhaust gas is introduced from circumferentially to form a swirling flow inside the mixer.

3. The combustion appliance for raising the temperature of the exhaust gas as claimed in claim 2, wherein, relative to a total opening area of the combustion air inflow holes, the peripheral fins and the end fins, an opening area of the combustion air inflow holes is set to 10%, an opening area of the end fins is set to 50-70%, and a remainder is allocated as an opening area of the peripheral fins.

4. The combustion appliance for raising the temperature of the exhaust gas as claimed in claim 3, wherein a bend-up angle of the peripheral fins is set to 40-55° to the periphery of the inner cylinder.

5. The combustion appliance for raising the temperature of the exhaust gas as claimed in claim 2, wherein the end fins and the tapered-surface fins are made through cutting and bending-up circumferentially in the same direction such that the swirling flow can be formed by the tapered-surface fins in a forward direction same as that of the swirling flow formed by the end fins.

6. The combustion appliance for raising the temperature of the exhaust gas as claimed in claim 5, wherein, relative to a total opening area of the combustion air inflow holes, the peripheral fins and the end fins, an opening area of the combustion air inflow holes is set to 10%, an opening area of the end fins is set to 50-70%, and a remainder is allocated as an opening area of the peripheral fins.

7. The combustion appliance for raising the temperature of the exhaust gas as claimed in claim 6, wherein a bend-up angle of the peripheral fins is set to 40-55° to the periphery of the inner cylinder.

8. The combustion appliance for raising the temperature of the exhaust gas as claimed in claim 5, wherein an opening area of the end fins is set to 50-70% of a total opening area of the combustion air inflow holes, the peripheral fins and the end fins, and a remainder is allocated as opening areas of the combustion air inflow holes and of the peripheral fins.

9. The combustion appliance for raising the temperature of the exhaust gas as claimed in claim 8, wherein, relative to a total opening area of the combustion air inflow holes, the peripheral fins and the end fins, an opening area of the combustion air inflow holes is set to 10%, an opening area of the end fins is set to 50-70%, and a remainder is allocated as an opening area of the peripheral fins.

10. The combustion appliance for raising the temperature of the exhaust gas as claimed in claim 9, wherein a bend-up angle of the peripheral fins is set to 40-55° to the periphery of the inner cylinder.

11. A combustion appliance for raising a temperature of exhaust gas arranged in a bend of an exhaust pipe to raise the temperature of exhaust gas through burner combustion, the appliance comprising:

a fuel injection nozzle to inject fuel downstream in a direction of flow of the exhaust gas in the bend of said exhaust pipe, an ignitor to ignite fuel mist injected from said fuel injection nozzle, a double-cylinder type flame stabilizer coaxially surrounding the injection nozzle and the ignitor about the injection nozzle, a toroidal blocking plate on a distal end of said stabilizer to close between inner and outer cylinders of said stabilizer, a combustion air introduction line connected to a proximal end of said stabilizer to introduce combustion air to between said inner and outer cylinders, a plurality of combustion air inflow holes formed throughout a periphery of said inner cylinder at a proximal end thereof, a plurality of peripheral fins formed on the periphery of said inner cylinder radially inwardly through cutting and bending-up at positions shifted from said inflow holes toward a distal end of the inner cylinder such that the combustion air is introduced circumferentially to form a swirling flow inside the inner cylinder, and a plurality of end fins formed on said blocking plate in a direction of fuel injection through cutting and bending-up such that the combustion air is discharged circumferentially to form a swirling flow around flame blown out of said inner cylinder, wherein the peripheral fins and the end fins are made through cutting and bending-up circumferentially in opposite directions such that the swirling flow can be formed by the end fins in a direction opposite to that of the swirling flow formed by the peripheral fins, wherein the end fins and tapered-surface fins are made through cutting and bending-up circumferentially in the same direction such that the swirling flow can be formed by the tapered-surface fins in a forward direction same as that of the swirling flow formed by the end fins, and wherein an opening area of the end fins is set to 50-70% of a total opening area of the combustion air inflow holes, the peripheral fins and the end fins, and a remainder is allocated as opening areas of the combustion air inflow holes and of the peripheral fins.

12. A combustion appliance for raising a temperature of exhaust gas arranged in a bend of an exhaust pipe to raise the temperature of exhaust gas through burner combustion, the appliance comprising:

a fuel injection nozzle to inject fuel downstream in a direction of flow of the exhaust gas in the bend of said exhaust pipe, an ignitor to ignite fuel mist injected from said fuel injection nozzle, a double-cylinder type flame stabilizer coaxially surrounding the injection nozzle and the ignitor about the injection nozzle, a toroidal blocking plate on a distal end of said stabilizer to close between inner and outer cylinders of said stabilizer, a combustion air introduction line connected to a proximal end of said stabilizer to introduce combustion air to between said inner and outer cylinders, a plurality of combustion air inflow holes formed throughout a periphery of said inner cylinder at a proximal end thereof, a plurality of peripheral fins formed on the periphery of said inner cylinder radially inwardly through cutting and bending-up at positions shifted from said inflow holes toward a distal end of the inner cylinder such that the combustion air is introduced circumferentially to form a swirling flow inside the inner cylinder, and a plurality of end fins formed on said blocking plate in a direction of fuel injection through cutting and bending-up such that the combustion air is discharged circumferentially to form a swirling flow around flame blown out of said inner cylinder, wherein the peripheral fins and the end fins are made through cutting and bending-up circumferentially in opposite directions such that the swirling flow can be formed by the end fins in a direction opposite to that of the swirling flow formed by the peripheral fins, and wherein, relative to a total opening area of the combustion air inflow holes, the peripheral fins and the end fins, an opening area of the combustion air inflow holes is set to 10%, an opening area of the end fins is set to 50-70%, and a remainder is allocated as an opening area of the peripheral fins.

13. The combustion appliance for raising the temperature of the exhaust gas as claimed in claim 12, wherein a bend-up angle of the peripheral fins is set to 40-55° to the periphery of the inner cylinder.

* * * * *